United States Patent [19]

Czenkusch

[11] 4,290,777

[45] Sep. 22, 1981

[54] REGENERATION OF FERRIC IONS IN COAL DESULFURIZATION PROCESS

[75] Inventor: Edward L. Czenkusch, Bartlesville, Okla.

[73] Assignee: Phillips Petroleum Co., Bartlesville, Okla.

[21] Appl. No.: 106,344

[22] Filed: Dec. 21, 1979

[51] Int. Cl.[3] ..... C10L 9/02

[52] U.S. Cl. ..... 44/1 SR; 201/17

[58] Field of Search ..... 44/1 SR; 75/6; 201/17

[56] References Cited

U.S. PATENT DOCUMENTS

| | | | |
|---|---|---|---|
| 3,053,651 | 9/1962 | McGauley | 75/6 X |
| 3,768,988 | 10/1973 | Meyers | 44/1 SR |
| 3,917,465 | 12/1975 | Meyers | 44/1 SR |
| 4,233,034 | 11/1980 | Miller et al. | 44/1 SR |

OTHER PUBLICATIONS

American Chem. Soc. Div. of Fuel Chem. vol. 17, No. 2, Chem. Removal of Pyritic Sulfur from Coal, Hamersma et al., 1972, pp. 1–14.

Desulfurization of Coal, Science, 1972, pp. 1187–1188.

*Primary Examiner*—Carl F. Dees

[57] ABSTRACT

A process for removing sulfur from coal using a ferric solution wherein iron loss by precipitation of insoluble iron compounds is controlled by regulation of the hydrogen ion concentration of the reaction slurry. The pH or other measurable condition at which the process is at least self-sustaining with respect to ferric ions is determined for a particular coal sample. The reaction slurry is monitored for changes in the chosen condition which signal a loss of iron from solution, and acid is automatically added as needed to prevent iron precipitation or to return precipitated iron to solution.

23 Claims, 1 Drawing Figure

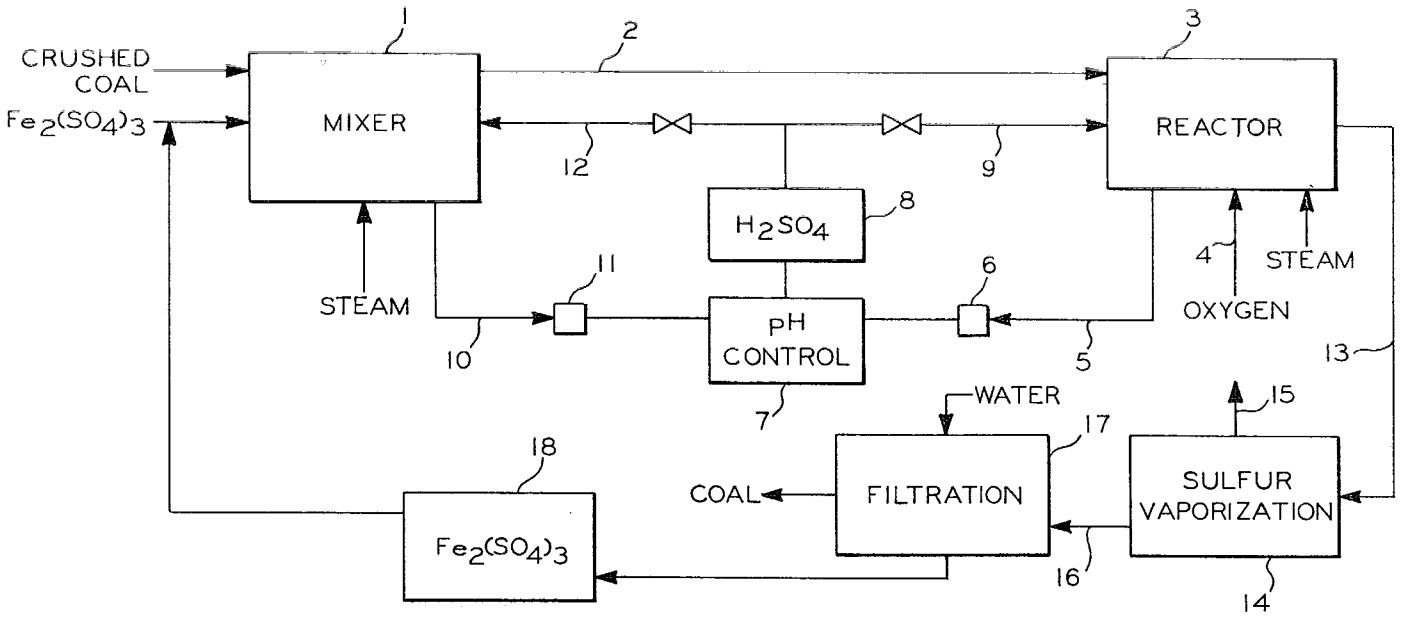
CRUSHED COAL
$Fe_2(SO_4)_3$
MIXER
STEAM
REACTOR
STEAM
OXYGEN
$H_2SO_4$
pH CONTROL
SULFUR VAPORIZATION
WATER
FILTRATION
COAL
$Fe_2(SO_4)_3$
1
2
3
4
5
6
7
8
9
10
11
12
13
14
15
16
17
18

REGENERATION OF FERRIC IONS IN COAL DESULFURIZATION PROCESS

BACKGROUND OF THE INVENTION

This invention relates to the removal of sulfur from coal using a ferric solution. It further relates to a method of monitoring the desulfurization process to prevent the loss of iron from solution by precipitation of insoluble iron compounds.

The combustion of coal which contains sulfur can release sulfur dioxide into the atmosphere and thus represents a potential serious health and environmental problem. It is necessary to remove this sulfur either by post-combustion treatment of the sulfur emissions or by pre-combustion treatment of the coal itself. One of the processes for removing pyritic sulfur ($FeS_2$) from coal is disclosed in U.S. Pat. No. 3,768,988. This process, commonly called the Myers process, involves the aqueous extraction of sulfur from pyrites in coal using a solution containing a ferric ion. In the process of freeing the sulfur from the pyrite, the iron is chemically reduced and is present in the resulting slurry as ferrous ions. It is economically necessary in such a process to be able to regenerate ferric ions for reuse in the desulfurization process. As disclosed in the patent referred to above, the conventional method for regeneration of ferric ions from ferrous ions is the air oxidation of the ferrous ions back to ferric ions. It has now been found that exposure of the iron ions to oxygen, particularly in this reoxidation process, can result in the loss of a part of the desulfurization reagent and contamination of the coal through the precipitation of iron-containing solids out of the reaction slurry. The problem is especially serious if the coal contains large amounts of basic materials.

It is thus an object of this invention to provide a method of controlling loss of iron ions as precipitated solids in the desulfurization of coal using an iron-containing reagent.

It is a further object to make the desulfurization process at least self-sustaining with respect to ferric ions.

It is a further object of this invention to provide a system for the regulation of the pH of a desulfurization reaction slurry.

SUMMARY OF THE INVENTION

In the process of removing sulfur from coal using a solution of ferric ions, precipitation of iron solids is controlled during desulfurization of the coal and regeneration of ferric ions by the addition of an acid to the reaction solution. The reaction solution can be monitored for changes in pH or other properties which indicate conditions under which iron precipitation occurs, and sufficient acid can be added to restore conditions favorable to retention of iron ions in solution or to recover iron ions which have precipitated from the solution. The specific conditions under which acid must be added depend upon the characteristics of the coal being desulfurized, and the critical pH can be determined experimentally for each type of coal.

BRIEF DESCRIPTION OF THE DRAWING

The FIGURE is a simplified flow diagram showing an embodiment of the process of the invention.

DETAILED DESCRIPTION OF THE INVENTION

The invention is suitable for coal desulfurization processes in which an iron compound is used as a desulfurization reagent and the iron is reduced from a higher to a lower valence state during the process. Exemplary of such processes is the use of an aqueous iron salt solution in the aqueous extraction of pyritic sulfur from coal, as practiced in the Myers process and disclosed in various patents including U.S. Pat. Nos. 3,768,988 and 3,917,465, the disclosures of which are hereby incorporated by reference.

In the aqueous extraction of pyritic sulfur from coal, crushed coal is refluxed with an aqueous solution of a ferric compound. The ferric compound is preferably ferric chloride or ferric sulfate but it can be other ferric salts such as, for example, ferric acetate and ferric citrate.

The process which occurs can be generally described by the following chemical equation showing the reaction of ferric sulfate with iron disulfide (present in coal in the form of pyrite or marcasite) to produce ferrous sulfate and free sulfur:

$$FeS_2+4.6Fe_2(SO_4)_3+4.8H_2O \rightarrow 10.2FeSO_4+4.8H_2SO_4+0.8S \quad (1)$$

The iron is thus reduced from ferric ions to ferrous ions and hydrogen ions are generated. Part of the pyritic sulfur (theoretically 60%) is converted to sulfate sulfur and the rest to elemental sulfur. The iron sulfate dissolves in the solution and the sulfur can be removed from the coal by vaporization or solvent extraction.

In order to regenerate ferric ions for reuse, the ferrous ions are usually oxidized with air according to the following chemical equation:

$$2.4O_2+9.6FeSO_4+4.8H_2SO_4 \rightarrow 4.8Fe_2(SO_4)_3+4.8H_2O \quad (2)$$

The ferric sulfate reagent is thus regenerated and can be reused as the desulfurization agent.

As can be seen from the equations, hydrogen ions are produced in the desulfurization step and are consumed in the regeneration step. The treated coal or lignite often contains substances which are sufficiently basic to react with the hydrogen ions in the solution. These substances include $Al_2O_3$, $Fe_2O_3$, CaO, MgO, $Na_2O$, $K_2O$, and similar naturally-occurring basic constituents of coal. As a consequence of the consumption of hydrogen ions, there may not be sufficient acid to permit the complete oxidation of ferrous ions to ferric ions as shown in equation 2. A portion of the iron will then precipitate from the solution as iron oxide, a hydrous iron oxide, basic iron sulfate, or other insoluble iron species.

The present invention is a method of controlling the precipitation of iron and thereby preventing the loss of the desulfurization reagent by providing sufficient acid to the reaction mixture to offset the effects of side reactions which consume hydrogen ions. The invention process involves the continuous evaluation of the reaction slurry for chemical changes which signal conditions under which iron solids will precipitate from solution. This can involve, for example, the monitoring of such properties of the solution as the hydrogen ion concentration or the iron ion (ferric or ferrous) concentration. In a preferred embodiment, the process involves the determination of the pH which must be maintained for each type of coal being treated and the monitoring of the reaction to insure that the necessary pH level is maintained by addition of acid at the appropriate times. As used herein, "slurry" includes not only the mixture of desulfurization reagent and coal, but also includes the aqueous solution comprising ferric and ferrous ions which results from the coal-reagent reaction.

In an alternate embodiment, the concentration of $Fe^{+3}$ in the reaction slurry can be monitored by, for example, a photometric method based on the light absorbance of a complex of ferric chloride in concentrated hydrochloric acid. A sample slurry stream is removed from the desulfurization reaction vessel and diluted with concentrated hydrochloric acid, causing the formation of a deeply-colored ferric chloride complex. The solution containing the complexed ions is passed through a photometer in which light absorbance, proportional to the concentration of complexed iron(III), is measured. The measured light absorbance is compared with a preselected light absorbance value determined to correspond to the desired ferric ion concentration. Responsive to a measured decrease in the preselected light absorbance, a control output signal is generated to open acid addition valves and add acid to inhibit iron loss from the solution. A commercial analyzer, such as an Autoanalyzer made by Technicon Industrial Systems, can be adapted for such a photometric analysis.

The process of the invention is particularly adapted to desulfurization processes in which the desulfurization step and the regeneration of the desulfurization agent are performed concurrently in the same vessel, but it can also be used in desulfurization processes in which the reaction solution is first separated from the coal and then oxidized in a separate vessel.

The acid used can be any organic or inorganic acid which is not itself so strong an oxidizing agent as to oxidize the coal. Examples of suitable acids include sulfuric, hydrochloric, acetic and citric. It is preferred to use an acid which corresponds to the iron salt used as the desulfurization reagent. When ferric sulfate is the desulfurization reagent, sulfuric acid will generally be used to replace hydrogen ions. Nitric acid in appreciable amounts should not be used because of its tendency to oxidize and nitrate the coal itself.

The process will be described in greater detail by reference to the FIGURE, which shows an embodiment of the invention in which ferric sulfate is used in a desulfurization process in which chemical leaching and reagent regeneration occur concurrently in the reaction vessel.

Crushed coal and aqueous ferric sulfate leaching solution are introduced into mixing vessel 1, where the coal is thoroughly contacted with the desulfurization reagent. The coal particle size is not critical but will generally be 150 microns to 10 mm. Treatment of finely crushed coal (2 mm top size) offers the advantages of faster sulfur removal and the possibility of simultaneous leaching-regeneration, while processing of coarse coal particles (5–10 mm top size) has the advantage of direct coal shipment without pelletizing.

Steam is added to the mixing vessel to heat the slurry to about 100° C. Agitators in the mixing vessel promote intimate contact of the coal with the desulfurization reagent. Slurry stream 2 can be passed through a foam breaker (not shown) before being introduced into pressure reactor 3. The desulfurization reaction takes place to some extent in the mixing vessel, but most of the sulfur removal occurs in the pressure reactor.

In reactor 3, the coal is refluxed with ferric sulfate at a temperature of 100° to 140° C. for 30 minutes to two hours or more, depending upon the size and nature of the coal being treated. Atmospheric pressure is suitable for the reaction, but pressures up to 100 psig may be used.

Oxygen 4 is introduced under pressure to oxidize the ferrous ions being formed during the leaching reaction.

A sample stream 5 of the reaction slurry is continuously measured for pH by pH sensor 6, which will generally be a glass electrode. Electrodes suitable for use at high temperature and pressure are commercially available. The pH measurements from the sensor are transmitted to pH controller 7, where the pH measurements are compared with a pH setpoint which is representative of the acidity necessary to prevent loss of the desulfurization reagent by precipitation of iron solids. High pH deviation from this setpoint, indicating neutralization of sulfuric acid and thus precipitation of iron, activates a signal to sulfuric acid source 8 from which sulfuric acid is pumped into the reactor through 9. When the pH of the reaction slurry returns to the level necessary to maintain the desired concentration of iron ions in solution, acid addition is terminated. The addition of acid can be intermittent, with time between acid additions to allow complete mixing of the acid in the solution. The vessel into which the acid is added may contain stirring means to insure even distribution of the acid throughout the solution. Optionally, sample stream 10 can be continuously monitored by electrode 11 for pH changes which signal iron precipitation in the mixer, and acid can be added through 12.

The acid concentration which must be maintained to prevent iron loss is dependent upon all the reaction variables, including the type of coal, the desulfurization reagent, the acid added to replace hydrogen ions, the quantity of basic constituents in the coal, and the amount of pyritic sulfur in the coal. In desulfurization processes in which ferric sulfate is the desulfurization reagent and sulfuric acid is the source of hydrogen ions, the hydrogen ion concentration will generally be at least $1.0\times10^{-2}$ moles/liter. The chemical reactions which will have the greatest effect on the amount of acid present are the oxidation of the pyritic sulfur, during which hydrogen ions are formed and ferric ions are reduced to ferrous ions, regeneration of ferric ions by oxidation of ferrous ions, during which hydrogen ions are consumed, and neutralization of hydrogen ions by basic constituents of the coal, as a result of which hydrogen ions are consumed and the self-sustaining balance of the iron reduction-reoxidation reactions is destroyed. The effect of the main reactions occurring when coal having high basicity is being desulfurized can be detected by an increase in pH. It is also possible that other reactions are occurring in the reaction mixture which have the opposite effect on pH. In coal which has a high basicity in comparison with the sulfur content, the effect of these reactions on the overall pH would not be expected to be significant, and the net effect of the competing reactions will generally be a rise in pH. The pH which must be maintained to keep the desired amount of iron in solution must be determined experimentally for each type of coal being desulfurized. Generally the concentration desired will be no higher than that necessary to make the process self-sustaining with respect to the iron reagent, but it may sometimes be desirable to inhibit precipitation of iron solids to an even greater extent.

Referring again to the FIGURE, reacted coal slurry is flashed via 13 into a gas-liquid separator vessel 14 and the gas goes off overhead in 15. The remaining slurry is routed via 16 to filtration unit 17, where the regenerated leach solution is recovered and pumped to a desulfurization reagent storage vessel 18.

The remaining coal is washed with water to remove residual iron salts. Free sulfur can be removed from the coal by vaporization or by extraction with a suitable solvent such as benzene, toluene, kerosene, gas oil or para cresol.

EXAMPLE

To illustrate the process of the invention, semi-anthracite coal from eastern Oklahoma was treated with ferric sulfate. Runs were made in a steam-headed, mechanically-stirred stainless steel pressure vessel having a capacity of 1100 ml. Compressed oxygen for regeneration of ferric ions was introduced through a sintered stainless steel sparger. The reactor contained 0.113 moles of ferric sulfate in 600 ml of solution. The runs were made at 121° C. and total pressure of 300 psig, with molecular oxygen providing the difference between water vapor pressure and total pressure. The coal contained 11.98 weight percent ash, 2.37 weight percent sulfur, and 2.17 weight percent iron. Table I summarizes the results of the runs performed.

TABLE I

| Run | Weight Coal(g) | U.S. Sieve Size | Moles $H_2SO_4$ Added | Time(hrs) | Treated Coal, Wt. % Ash | Sulfur | Iron | pH of Filtrate |
|---|---|---|---|---|---|---|---|---|
| 1 | 100 | −60 + 100 | 0 | 4 | 16.39 | 1.56 | 6.55 | — |
| 2 | 100 | −60 + 100 | 0.18 | 2 | 15.50 | 1.42 | 1.01 | — |
| 3 | 100 | −60 + 100 | 0.09 | 4 | 18.15 | 1.55 | 4.26 | — |
| 4 | 82.9 | −140 + 200 | 0.18 | 4 | 9.06 | 1.66 | 1.51 | 1.45[a] |
| 5 | 97.7 | −140 + 200 | 0 | 4 | 17.38 | 1.92 | 6.32 | 1.30[b] |
| 6 | 81.9 | −140 + 200 | 0.18 | 2 | 8.66 | 1.52 | 0.59 | 1.65[c] |

[a]Filtrate diluted with 2.4 liters of wash water before duplicate samples taken; pH of two samples was 1.4 and 1.5, respectively.
[b]Filtrate treated as described in footnote a; both samples had a pH of 1.3.
[c]Filtrate diluted with 1.2 liters of wash water; duplicate samples had pH of 1.3 and 2.0, respectively, indicating incomplete mixing of samples.

In each run, the sulfur content of the coal was decreased by treatment with ferric sulfate solution, but the iron content of the treated coal was a function of the concentration of sulfuric acid added. Runs 1 and 5, in which there was no added sulfuric acid, resulted in the greatest amounts of iron present after treatment of the coal. In both runs, the amount of iron after desulfurization treatment exceeded the amount of iron present in the untreated coal, indicating that iron was lost from the desulfurization reagent itself. Run 3, in which the solution was 0.15 molar in sulfuric acid, showed an improved solubility of iron, but precipitation of iron from the reagent was still great. Runs 2, 4 and 6, performed in solutions which were 0.3 molar in added sulfuric acid, yielded coal containing less iron than the starting coal. For coal which has the composition of the coal of these samples treated under the conditions described, about 0.15 to 0.3 molar sulfuric acid solution is required to prevent a net loss of iron from the desulfurization agent.

I claim:

1. A process for treating coal which comprises:

contacting the coal with an aqueous desulfurization reagent containing ferric ions and producing a reaction slurry comprising ferric ions, ferrous ions and hydrogen ions;

maintaining the hydrogen ion concentration of the reaction slurry at a level which inhibits precipitation of iron solids.

2. The process of claim 1 in which the hydrogen ion concentration is maintained by the controlled addition of acid to the reaction slurry.

3. The process of claim 2 which further comprises:

measuring the hydrogen ion concentration of the reaction slurry;

comparing the measured hydrogen ion concentration with a preselected value determined to be effective in inhibiting the precipitation of iron solids; and adding acid to the reaction slurry in response to a measured hydrogen ion concentration which is lower than the preselected value.

4. The process of claim 3 in which the acid is selected from the group consisting of sulfuric acid, hydrochloric acid, acetic acid, and citric acid.

5. The process of claim 3 in which the acid is sulfuric acid.

6. The process of claim 3, 4 or 5 in which the preselected value for the hydrogen ion concentration is at least $1.0\times10^{-2}$ moles per liter.

7. The process of claim 1, 2, 3, 4 or 5 in which the preselected value for the hydrogen ion concentration is chosen so as to maintain a concentration of iron ions at least equal to the concentration of ferric ions in the desulfurization reagent.

8. The process of claim 1, 2, 3, 4 or 5 in which the coal contains at least one naturally-occurring base.

9. The process of claim 2 which further comprises:

measuring the ferric ion concentration of the reaction slurry;

comparing the measured ferric ion concentration with a preselected value which is at least as high as the ferric ion concentration of the aqueous solution containing ferric ions; and adding acid to the reaction slurry in response to a measured ferric ion concentration which is lower than the preselected value.

10. The process of claim 9 in which the ferric ion concentration is measured by a colorimetric method.

11. The process of claim 10 in which the colorimetric method comprises:

diluting a sample of the reaction slurry with hydrochloric acid so as to form a solution containing a ferric chloride complex;

measuring the light absorbance of the solution containing a ferric chloride complex;

comparing the light absorbance of the solution containing a ferric chloride complex with a preselected light absorbance value representative of a concentration of ferric ions in the reaction slurry which is at least as high as the ferric ion concentration in the desulfurization reagent.

12. A process for treating coal which comprises:

contacting coal containing at least one naturally-occurring base with an aqueous desulfurization reagent containing ferric ions and producing a reaction slurry comprising ferric ions, ferrous ions and hydrogen ions;

regenerating ferric ions by oxidation of the ferrous ions;

maintaining the hydrogen ion concentration of the reaction slurry at a level which inhibits precipitation of iron solids during the regenerating step.

13. The process of claim 12 in which the hydrogen ion concentration is maintained by the controlled addition of acid to the reaction slurry.

14. The process of claim 13 which further comprises:

measuring the hydrogen ion concentration of the reaction slurry;

comparing the measured hydrogen ion concentration with a preselected value determined to be effective in inhibiting the precipitation of iron solids; and adding acid to the reaction slurry in response to a measured hydrogen ion concentration which is lower than the preselected value.

15. The process of claim 14 in which the acid is sulfuric acid and the preselected value for the hydrogen ion concentration is at least $1.0\times10^{-2}$ moles per liter.

16. The process of claim 12, 13, 14 or 15 in which the reaction slurry further comprises the coal being treated and the treatment of the coal and the regeneration of ferric ions take place concurrently.

17. The process of claim 13 which further comprises:

measuring the ferric ion concentration of the reaction slurry;

comparing the measured ferric ion concentration with a preselected value which is at least as high as the ferric ion concentration of the desulfurization reagent; and adding acid to the reaction slurry in response to a measured ferric ion concentration which is lower than the preselected value.

18. The process of claim 17 in which the acid is selected from the group consisting of sulfuric acid, hydrochloric acid, acetic acid, and citric acid.

19. The process of claim 17 in which the acid is sulfuric acid.

20. The process of claim 18 in which the preselected value for the hydrogen ion concentration is at least $1.0\times10^{-2}$ moles per liter.

21. The process of claim 17 in which the ferric ion concentration is measured by a colorimetric method.

22. The process of claim 21 in which the colorimetric method comprises:

diluting a sample of the reaction slurry with hydrochloric acid so as to form a solution containing a ferric chloride complex;

measuring the light absorbance of the solution containing a ferric chloride complex;

comparing the light absorbance of the solution containing a ferric chloride complex with a preselected light absorbance value representative of a concentration of ferric ions in the reaction slurry which is at least as high as the ferric ion concentration in the desulfurization reagent.

23. The process of claim 1, 2, or 3 in which the slurry further comprises the coal being treated.

* * * * *